United States Patent [19]

Koster et al.

[11] 3,995,915

[45] Dec. 7, 1976

[54] SLIDING BEARING FOR BRIDGES OR SIMILAR STRUCTURES

[75] Inventors: Waldemar Koster, Forsbach, Germany; Reinhold Huber, Rorbas, Switzerland

[73] Assignee: Kober AG, Glarus, Switzerland

[22] Filed: Dec. 19, 1975

[21] Appl. No.: 642,256

[30] Foreign Application Priority Data

| | | |
|---|---|---|
| Dec. 27, 1974 | Germany | 2461708 |
| June 23, 1975 | Germany | 198491[U] |
| Nov. 14, 1975 | Germany | 2551085 |

[52] U.S. Cl. ..... 308/3 R; 14/16.1

[51] Int. Cl.[2] ..... F16C 27/06

[58] Field of Search ..... 308/3 R; 14/16 R, 16 B; 248/22

[56] References Cited

UNITED STATES PATENTS

| | | | |
|---|---|---|---|
| 3,782,788 | 1/1974 | Koester et al. | 308/3 R |
| 3,782,789 | 1/1974 | Koester et al. | 308/3 R |
| 3,924,907 | 12/1975 | Czernik et al. | 308/3 R |

*Primary Examiner*—M. H. Wood, Jr.
*Assistant Examiner*—Gene A. Church

[57] ABSTRACT

A slide-rocker bearing having an elastic pressure cushion arranged between a pair of opposed bearing members, peripherally enclosed in a casing which is spaced from the bearing members so as to permit at least one of the bearing members to tilt. A slide plate is interposed between the tiltable bearing member and the pressure cushion and support means is inserted at least between the marginal edges of the slide plate and the pressure cushion. Means are provided for fixing the slide plate support means to the casing and thereby enclose the support within the peripheral confines of the casing in contact with the pressure cushion.

19 Claims, 4 Drawing Figures

SLIDING BEARING FOR BRIDGES OR SIMILAR STRUCTURES

BACKGROUND OF THE INVENTION

The present invention relates to a slide-rocker bearing for bridges or similar structures.

Bearings of this type generally comprise a deformable elastic pressure cushion arranged between an upper bearing member and a lower bearing member. The pressure cushion is peripherally enclosed by a cylindrical casing which is spaced from the bearing members allowing tilting movement under deforming load conditions placed upon one of the bearings. A slide plate of such low friction material as polytetrafluoroethylene (PTFE) is interposed between the upper bearing member and the pressure cushion so as to provide an easily slidable surface for the upper bearing member. A slide-rocker bearing of the above type is shown in German Pat. No. 2,353,733. In the construction shown in this publication the casing is provided with a shoulder which is directed radially inwardly and which is provided with a bore, in which the peripheral edge of a PTFE slide plate is received. Otherwise, the slide plate rests directly upon the elastic pressure cushion. As a result during tilting movements of the bearing, which always lead to eccentricity in the load application, the radially extending internal edge of the bore cuts into the PTFE slide plate, endangering the mounting or encasement of the PTFE sliding plate within the bore itself making it possible for the slide plate to emerge through the gap or space between the casing and the adjacent bearing member. The ability of the slide plate to be further dislodged is increased by the counter deformation energy applied by the pressure cushion itself to the resilient PTFE slide plate. Thus, deformation is frictionally followed by a creeping of the material of the pressure cushion itself into the area of the deformation. This is emperically observed, during tests, as a symptom of tilting movements, occuring in the marginal area of the pressure cushion edge. When heavy bearing loads and large angles of tilt are involved, the known slide rocker bearings may become unsafe and the PTFE slide plate may become completely dislodged.

SUMMARY OF THE INVENTION

According to the present invention a slide-rocker bearing is provided in which an elastic pressure cushion is arranged between a pair of opposed bearing members, and is peripherally enclosed in a casing which is spaced from the bearing members so as to permit at least one of the bearing members to tilt. A slide plate is interposed between the tiltable bearing member and the pressure cushion. Support means for the slide plate is inserted at least between the marginal edges of the slide plate and the pressure cushion and means are provided for fixing the slide plate support means to the casing and thereby enclose the support within the peripheral confines of the casing in contact with the pressure cushion.

According to the present invention the disadvantages known in the prior art are overcome by the fact that the slide plate is held at least in its marginal area by the supporting means which is itself adapted to be engaged securely within the casing surrounding the pressure cushion. Preferably, the support means is made of a hard elastic material, i.e., a material less elastic than that of the pressure cushion and is partially embedded in the pressure cushion. The means by which the support means is fixed within the casing with respect to the pressure cushion, is preferably formed by a lug, integral with the support means or acting in cooperation therewith, projecting from the pressure cushion surface into a receiving groove formed on the inner surface of the casing. The support means, thus is resiliently movable with the pressure cushion and provides a resilient transition between the rigid casing and the softer pressure cushion, into which the PTFE slide plate can be firmly encased. By this means, compressive stress peaks, which endanger the shape stability of the PTFE slide plate are reliably avoided, at least in the dangerous marginal area, i.e., at the point where the emergence of the slide plate through the existing gaps between the casing and the bearing members is possible. Through the positive connection of the support means with the casing, the support means form as it were an articulated support of the marginal peripheral area of the slide plate.

The support means, which is resilient conjointly with the pressure cushion, ensures an equalization of the pressure in the possibly endangered marginal area of the encased PTFE slide plate, without obstructing the frictional connection between the pressure cushion and the slide plate. The supporting means may be firmly connected to the pressure cushion, or it may be lossely set on the latter. What is important however, is that it is conjointly movable or resilient with the pressure cushion while simultaneously being articulatingly fixed with respect to the peripheral casing.

In one embodiment of the present invention, the supporting means is designed as a ring which projects radially inward from the adjacent edge of the casing ring and has an internal edge which abuts the peripheral edge of the slide plate, in a flush manner and a contiguous ledge which embraces the edge of the slide plate from beneath and from the interior of the pressure cushion. The ledge is set below the upper surface of the ring so that the upper ring and the upper surface of the PTFE slide plate are coplaner and jointly form the sliding surface on which the associated bearing member is supported. In order to ensure a low degree of bearing friction, it is important that the supporting ring should consist of material having good sliding properties, such as polyacetal or polyamide. In this embodiment, the slide plate is thus fully accommodated in a marginal recess of the ring forming the support and with the use of the mentioned material a complete sealing of the gap between the casing and the bearing members is assured protecting fully the pressure cushion. Under load conditions, the supporting ring is adapted automatically to the level of the PTFE sliding plate since both rest on the resiliently elastic pressure cushion, so that a uniform distribution of the pressure in the area of the sliding plane of the bearing is ensured, even if the ring and sliding plate are not perfectly accurately fitted or mated to each other.

In another embodiment, the slide plate is accommodated in an enlarged bore formed on the end of the casing, the depth of the bore being smaller than the thickness of the sliding plate. The supporting member is arranged below the sliding plate to engage its bottom surface. In this embodiment, it is sufficient if the support is designed merely as a ring adapted to be set below the slide plate in contact with the under surface of the slide plate. The width of the ring should be sufficiently enlarged in the radial direction to ensure that the pressure compensating effect, in the marginal area of the slide plate is not endangered, and will resiliently move with the pressure cushion while maintaining support about the marginal edges.

In both of the foregoing embodiments, it is advantageous to shape the ring to have a conical surface on its lower side or edge in contact with the pressure cushion with a radius that increases outwardly from the top of the pressure cushion toward the bottom. As a result the ring will sit well on the pressure cushion and not be dislodged under loads. Further, the lug can be easily made integral with the ring and extending into the retaining groove of the casing.

In another embodiment of the present invention, the supporting means comprises a rigid plate inserted between the pressure cushion and the sliding plate. The rigid supporting plate is at least coextensive with the pressure cushion and its edges directly engage the inner surface of the peripheral casing. Separate engaging lug means is at least in part embedded in the pressure cushion directly beneath the rigid plate, and in part extending into the groove formed in the casing. In this manner, the lug is forced by the counter resiliency of the pressure cushion to resiliently act on the rigid plate supporting the slide member. The rigid plate, consisting preferably of a hard metal, presents a reliable support for the PTFE sliding plate and is on the other hand so elastic, by its combination with the pressure cushion that a frictional engagement between the pressure cushion and the slide plate is always provided under the load applied by and to the associated bearing member. The pressure cushion is preferably formed from a rubber-like material having high resiliency.

The rigid plate can either enter with its peripheral edge in an enlargement of the groove which would normally receive the lug or the casing can be provided with an inwardly extending collar, which collar projects toward the central axis of the bearing and which over lies the peripheral edge of the rigid plate. In either manner the pressure of the lug set in the groove of the casing, will firmly hold the rigid plate in place. In either instance, the slide member is made coextensive with the interior diameter of the casing so that its peripheral edge can abut the inner surface of the casing or of the collar and thus be held in place. Furthermore, a firm connection between the pressure cushion and the casing may be provided in this embodiment by forming the lug as an annular helical spring, which in itself is highly elastic and which will be virtually nonobstructive to the deformation of the pressure cushion under load conditions.

A particularly advantageous development of the supporting means consists by designing the latter so as to be deformable in a confined manner, at least in the region of the interengagement with the peripheral casing. Preferably, this can be obtained by forming this portion as a helical wire coil, half of which may be embedded in the pressure cushion, half of which forms the lug which engages the casing. This may also be accomplished by providing a lug integral with the supporting member having a circular cross section and fitting into a circular groove, as well as by means of the material chosen for the supporting means.

According to a further varient of the present invention the supporting means may also be formed as a plurality of individual, separate, radially aligned lamella or platelets which are arranged side by side uniformly about the periphery of the pressure cushion. The lamella or platelets are spaced from each other about the periphery of the pressure cushion and the spaces between them are filled with pressure cushion material. The lamella or platelets preferably consist of a hard material such as metal, and certain hard plastic materials. The narrow front end of the lamella or platelets extend approximately parallel to the inner surface of the casing, the lateral surfaces extend approximately vertically thereto while their transverse surfaces extend radially with respect to the central axis of the bearing and in a plane parallel to the slide plate.

Full details of the present invention are set forth in the following disclosure and are shown in the accompanying drawings.

DESCRIPTION OF THE INVENTION

Figure 1:
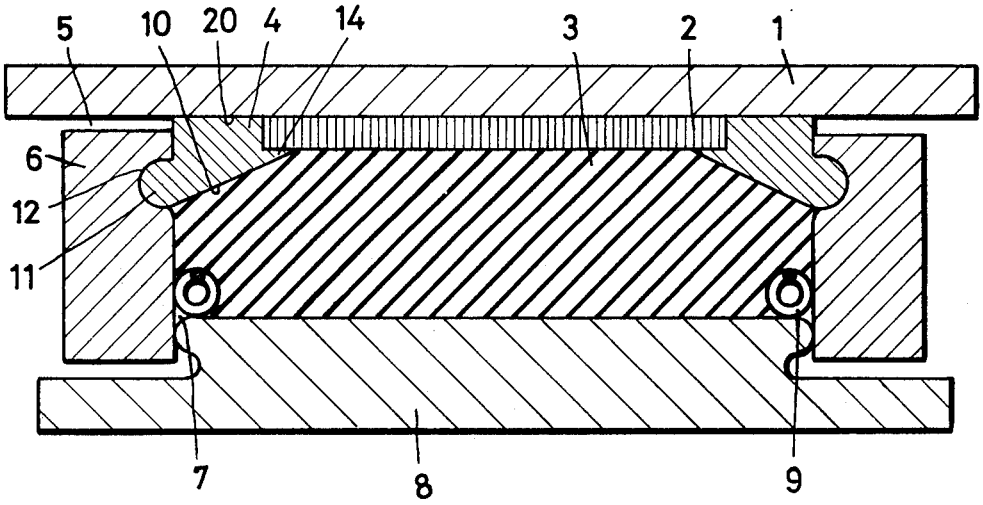
FIG. 1 is a vertical cross sectional view through the central axis of a bearing employing the present invention.

In FIG. 1, a slide-rocker bearing, embodying the principles of the present invention is shown, comprising an upper bearing member 1 slidably resting on a slide plate 2, made for example from PTFE which itself rests on a pressure cushion 3 made of rubbery elastic material, the periphery of which is enclosed in a cylindrical casing 6. The slide plate 2 is seated about its outer circumference in support means comprising a ring 4 which sits on the upper surface of the pressure cushion 3. The ring 4 serves simultaneously with its function as a seat, to seal the horizontal gap 5 formed between the upper bearing part 1 and the cylindrical casing 6 and to fix the casing 6 to the peripheral surface of the pressure cushion. The pressure cushion 3 rests on a lower bearing member 8 having a base and a central pedestal portion formed with a lateral convex shaped upper part extending into the casing 3.

The peripheral wall 6 extends below the pressure cushion 3, about the convex shape of the pedestal, but spaced from the base, forming a vertical gap 7 and a horizontal gap 15 which allows the casing 6 to tilt or rock. A seal, such as a helical wire coil 9, which is countersunk in the pressure cushion 3 serves to close the vertical gap 7 (and the horizontal gap 15) between the casing 6 and the lower bearing member 8. The successive turns of the coil 9 are spaced and the spaces are filled with the pressure cushion material and providing a stiffening effect and constricting effect on the pressure cushion material preventing this material from emerging through the vertical gap 7 in the downward direction.

The ring 4 is supperimposed, that is, it rests upon the pressure cushion 3 in a loose manner and is provided with a conical contacting surface 10 tapering upwardly in a decreasing radius toward the upper bearing member. The pressure cushion is similarly formed with a tapering surface to conform thereto. Thus any displacement of the pressure cushion material caused by tilting movement of the bearing are unobstructed along the lower conical surface 10 of the ring 4. It is possible to obtain a similar solution by embedding the ring, at least in part, as by forming it with ribs or the like, in the pressure cushion or with the same effect by subdividing the ring into several arcuate sectors, or by replacing the ring with a plurality of lamella, platelets or disc like members of similar cross section which are individually embedded within the pressure cushion material, in the manner later to be described in respect to FIG. 4.

The ring 4 is formed with a radially inwardly extending ledge 14 and a cylindrical wall extending to its upper surface. The ledge 14 thus forms a seat in which the slide plate 2 is received. Preferably the diameter of the cylindrical wall conforms to that of the slide plate so that it abuts the peripheral edge of the slide plate. The ledge 14, however, extends inwardly so that it engages the under surface of the slide plate, and is spaced from the upper surface 20 a distance substantially equal to the thickness of the slide plate, so that the upper surface of the slide plate lies coplanar with the surface 20.

The casing 6, peripherally enclosing the pressure cushion 3 is positively interlocked with the supporting means, or ring 4 by providing the ring 4 with radially outward extending annular lug 11 having a generally circular cross section. The lug 11 is adapted to enter into a corresponding groove 12 formed on the inner circumferential wall of the casing 6. If desired, the ring 4 may be further stiffened by a reinforcing helical wire coil, such as the wire coil 9 used for sealing the vertical gap 7, arranged in the area of the lug 11 adjacent the peripheral edge of the pressure cushion. On the other hand a wire coil or annular helix, embedded in the pressure cushion itself may be sufficient for resiliently fixing the pressure cushion relative to the casing ring as will be more clearly explained with respect to FIG. 2.

In order not to obstruct the tilting movements of the bearing but to nevertheless ensure that the upper bearing member always rests flately on the slide plate 2, and on the upper surface 20 of the supporting ring 4, the ring 4 is preferably made of a hard elastic material, whose deformability is limited but whose sliding qualties are good. In this manner creep deformation is allowed only to a very limited extent. Suitable known materials which can be used for this purpose are polyaectal and polyamide. Since the horizontal ledge 14, which forms the seat for the slide plate 2 engages beneath the PTFE sliding plate only about its peripheral marginal area, the remainder of the slide plate is in frictional contact with the pressure cushion. The horizontal ledge 14 being spaced from the upper surface 20 of the ring 4 by an amount substantially equal to the thickness of the slide plate 2, will prevent the emergence of the pressure cushion material from between the ring 4 and the slide plate 2, even if the same be dislodged during tilting since immediately after the load has been applied to the bearing and the slide plate will be caused to further positively seat within the supporting ring 4.

Figure 2:
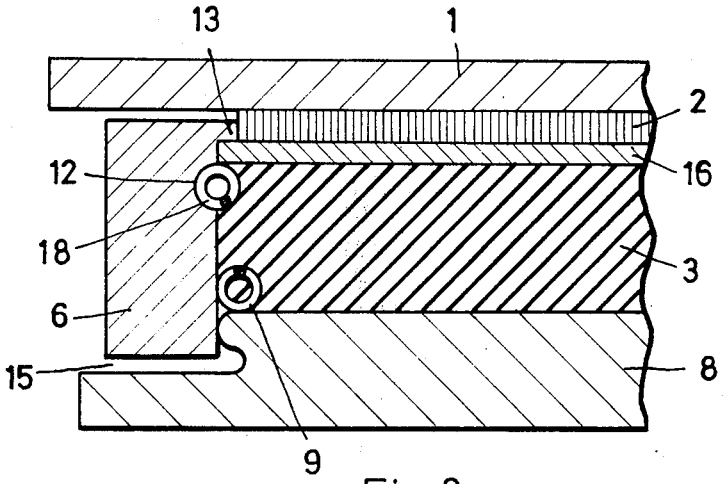
FIG. 2 is a partial view similar to that of FIG. 1 through a second bearing employing the present invention.

In the embodiment as shown in FIG. 2 wherein like reference numerals indicate parts identical to those shown in FIG. 1, the upper bearing member 1 is supported on the pressure cushion 2 so as to be also slidable in a horizontally displaceable manner, the slide plate 2 of PTFE material, being interposed therebetween as in the case of FIG. 1. However, between the slide plate 2 and the pressure cushion 3 there is arranged a support means comprising a rigid plate 16 preferably of steel or similar hard metal material which is coextensive with and covers the pressure cushion, to engage the inner surface of the casing.

The casing 6 is provided with a radially inwardly projecting collar 13 which engages over the peripheral edge of the rigid plate 16 and engages the peripheral edge of the slide plate 2, preventing the slide plate itself from sliding. An annular helical wire coil 18 having its axis of rotation in a plane parallel to the plane of bearing members, is arranged directly beneath the rigid plate 16 and is partially embedded in the pressure cushion and partially engages in the groove 12 formed on the inner wall of the casing 6. The coil 18 serves to fix the casing ring 6 relative to the pressure cushion 3 and simultaneously acts to seal the annular gap between the rigid plate 16 and the casing 6. In addition, through the loading of the pressure cushion 3, the rigid plate 16 is pressed against the underside of the collar 13 by the action of the coil 18. The horizontal clearance 15 between the lower bearing member 8 which permits the tilting movement of the casing 6 is sealed as in FIG. 1 by the helical wire coil 9. The lower coil 9 has a smaller diameter than that of the coil 18 and is preferably completely embedded within the pressure cushion 3.

Because the PTFE sliding plate is completely encased within the collar 13, between the bearing member 1 and the rigid plate 16 the upwardly drawn conical ring 4 having a seat such as shown in FIG. 1 is not necessary. If desired, the collar 13 may be avoided and the groove 12 enlarged to receive the rigid supporting plate 16 as well as the coil 18. In this event the slide plate 2 is conformingly enlarged to have its peripheral edge abut the inner wall surface of the casing 6. Further, the helical coil 18 can be replaced by individual lamella of the type shown for example in FIGS. 3 and 4.

Figure 3:
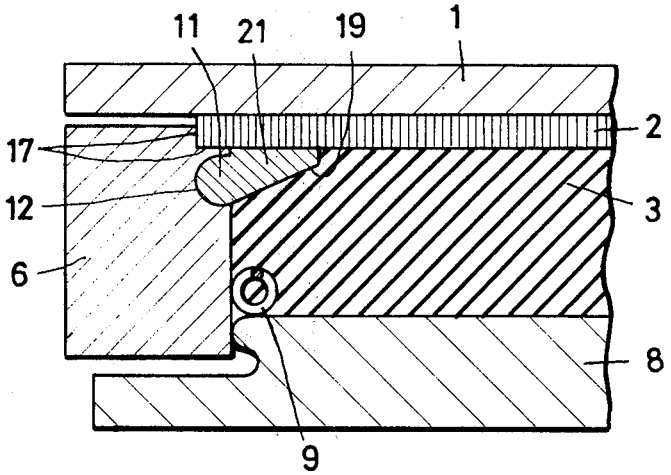
FIG. 3 is a view similar to that of FIG. 2 showing still another bearing employing the present invention.
Figure 4:
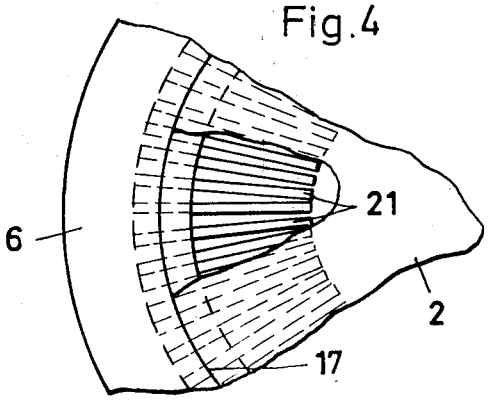
FIG. 4 is a plan view of a center of the bearing shown in FIG. 3, partially broken away to show the slide member, supporting means and pressure cushion.

The varient shown in FIGS. 3 and 4 in which like reference numerals also denote similar parts, provides for the axial edge for the casing 6 to be provided with a partial bore 17, of greater diameter, in which the slide plate 2 may be seated. The slide plate 2 is supported by an annular assembly 19 formed of a plurality of individual lamella or platelets 21 having a flat upper edge upon which the under surface of the slide plate 2 is adapted to rest. The lamella or platelets are uniformly arranged about the periphery of the pressure cushion 3 and have a lower conical surface and an outwardly extending lug 11, similar to that of the arrangement shown in FIG. 1. The lug 11 is received within the groove 12 which, thus acts under load conditions to join the casing 6 to the pressure cushion 3. The narrow front edges extend adjacent the casing 6 parallel to the surface of the casing, and has its latteral surfaces extending approximately vertical and radially disposed toward the central axis of the bearing. As with the use of a helical coil, the lamella or platelets being separated by the pressure cushion material in which they are embedded, have a resiliency in a direction revolving about the axis as well as axially and radially.

It will be seen from the foregoing that in all of the embodiments of the present invention support means for a slide plate is provided in which at least the marginal edges of the slide plate are held against dislodgment or separation from the pressure cushion and in which the emergence of pressure cushion material under tilting conditions is effectively prevented. Further the support means is resiliently movable conjointly with the pressure cushion and provides sufficient resilient transition between the rigid casing and the softer pressure cushion so as to prevent compressive stress peaks from endangering the stability of the sliding plate. Further the supporting means has a degree of resiliency and flexibility with respect to the pressure cushion and the surrounding peripheral casing wall effected by the use of a circular cross section lugs and or the similar cross section helical coils which effectively act as a lug so that the tilting of the bearing is unobstructed. In addition it will be observed that supporting means act as an effective seal to close the space around the pressure cushion.

Various embodiments have been illustrated herein and several varients in which aspects of one embodiment have been combined with aspects of another embodiment have also been disclosed. Those skilled in the present art will readily recognize still other embodiments or varients, it is therefore intended that the present disclosure be taken as illustrative of the present invention only and not as limiting of its scope.

What we claim is:

1. A slide-rocker bearing comprising a pair of spaced bearing members an elastic pressure cushion arranged between said bearing members, a casing at least in part peripherially enclosing said pressure cushion and spaced from said bearing members so as to permit tilting thereof, a slide plate interposed between one of said bearings and said pressure cushion, support means inserted at least between the marginal edges of said slide plate and said pressure cushion, and means for engaging said support means with said casing.

2. The bearing according to claim 1 wherein said support comprises a ring projecting from the adjacent edge of the casing forming a seat for said slide plate having an inner edge abutting the edge of the slide plate in a flush manner and embracing the peripheral margin of said slide plate on the interior surface thereof.

3. The bearing according to claim 2 wherein said ring is provided with a conical lower surface engaging said pressure cushion tapering outward in an increasing radius.

4. The bearing according to claim 2 wherein said support means comprises a ring having an inner diameter conforming to said slide plate, an upper surface adapted to project axially above the edge of said casing and a radially inwardly directing ledge for receiving said slide plate, said ledge being spaced from said upper surface a distance conforming substantially to the depth of said slide plate wherein said slide plate and said surfaces are substantially coplanar.

5. The bearing according to claim 4 wherein the engagement means comprises a lug projecting outwardly integrally from said support and a conforming groove formed within the inner wall of said casing for receiving said lug.

6. The bearing according to claim 1 wherein said casing is provided with an enlarged bore at its upper end for receiving said slide plate, said bore having a depth less than the thickness of said slide plate and said supporting means being located within said casing to abut the lower surface of said slide plate.

7. The bearing according to claim 6 wherein said supporting means comprises a ring extending about the periphery of said casing.

8. The bearing according to claim 7 wherein engagement means comprises a lug projecting outwardly integrally from said support and a conforming groove formed within the inner wall of said casing receiving said lug.

9. The bearing according to claim 7 wherein said ring is provided with a conical lower surface engaging said pressure cushion tapering outward in an increasing radius.

10. The bearing according to claim 1 wherein said support comprises a rigid plate inserted between said slide plate and said pressure cushion and engaging said casing, said rigid plate being secured within said casing by said engaging means and said casing.

11. The bearing according to claim 10 wherein said casing has a collar at its upper edge engaging the peripheral edge of said slide plate and overlying said rigid plate.

12. The bearing according to claim 10 wherein said engaging means included a lug spaced about the periphery of said pressure cushion and engaging the lower surface of said rigid plate support and projecting outwardly thereof into a conforming groove formed in the inner wall of said casing.

13. The bearing according to claim 12 wherein said lug is formed of an annular wire coil partially embedded within said pressure cushion.

14. The bearing according to claim 1 wherein said support means comprises a plurality of lamalla uniformly spaced about the periphery of said casing and being at least partially embedded radially within said pressure cushion.

15. The bearing according to claim 14 wherein said lamalla have an edge extending approximately parallel to the inner surface of said casing and lateral surfaces extending approximately vertical thereto.

16. The bearing according to claim 1 wherein said support means is at least partially embedded within said pressure cushion.

17. The bearing according to claim 1 wherein said slide plate is formed of polytetrafluoroethylene (PTFE).

18. The bearing according to claim 1 wherein said support means is formed of elastic material, less resiliant than that of said pressure cushion.

19. The bearing according to claim 1 wherein said bearing members are arranged one above the other and the lower bearing is formed with a base and a pedestal portion for bearing said pressure cushion and said peripheral casing extends axially from said pressure cushion at least in surrounding said pedestal portion and being spaced from said base.

* * * * *